United States Patent [19]

Catanzarite

[11] 3,964,255

[45] June 22, 1976

[54] METHOD OF INFLATING AN AUTOMOBILE PASSENGER RESTRAINT BAG

[75] Inventor: Vincent Owen Catanzarite, Las Vegas, Nev.

[73] Assignee: Specialty Products Development Corporation, Medina, Ohio

[22] Filed: Oct. 17, 1973

[21] Appl. No.: 407,268

Related U.S. Application Data

[63] Continuation-in-part of Ser. No. 234,312, March 13, 1972, abandoned.

[52] U.S. Cl. ..... 60/205; 149/75; 149/77; 149/109.2; 280/728

[51] Int. Cl.[2] ..... C06D 5/00; C06B 29/00; C06B 29/02; B60R 27/00

[58] Field of Search ..... 149/109.2, 75, 77; 60/205; 280/150 AB; 252/187 R, 188.3 R

[56] References Cited

UNITED STATES PATENTS

| | | | |
|---|---|---|---|
| 2,055,126 | 9/1936 | Goldsmith | 149/83 |
| 2,904,420 | 9/1959 | Holker | 149/61 |
| 3,193,421 | 7/1965 | Sutton | 149/19.4 |
| 3,362,859 | 1/1968 | Sutton | 149/19.5 |
| 3,618,980 | 11/1971 | Leising | 280/150 AB |
| 3,690,971 | 9/1972 | Gunderloy | 149/76 |
| 3,692,495 | 9/1972 | Schneiter | 280/150 AB |
| 3,734,789 | 5/1973 | Moy | 149/19.6 |
| 3,773,351 | 11/1973 | Catanzarite | 280/150 AB |
| 3,778,084 | 12/1973 | Sutherland | 280/150 AB |
| 3,779,825 | 12/1973 | Blackwell | 149/19.9 |
| 3,785,149 | 1/1974 | Timmerman | 60/205 |
| 3,862,866 | 1/1975 | Timmerman | 149/21 |
| R26,468 | 10/1968 | Sutton | 149/19.4 |

FOREIGN PATENTS OR APPLICATIONS 480,330 2/1938 United Kingdom

OTHER PUBLICATIONS

"Organic Chemistry" by Morrison and Boyd, (1959), p. 677.

*Primary Examiner*—Benjamin R. Padgett
*Assistant Examiner*—Donald P. Walsh
*Attorney, Agent, or Firm*—Christie, Parker & Hale

[57] ABSTRACT

A pyrotechnic powder composition comprising a mixture of an oxidizer compound containing oxygen and a metal selected from the group consisting of sodium, potassium, lithium, barium, magnesium and calcium, and an oxygen bearing metal organic compound is used for inflating a passenger restraint bag for an automobile. The compounds are selected so that a stoichiometric reaction between the oxidizer and the oxygen bearing metal organic compound yields carbon dioxide and water vapor and at least a binary mixture of metal salts having a melting point substantially below the melting point of any of the resultant metal salts alone, and having net heat of reaction less than about 1,000 calories per gram of pyrotechnic composition. One preferred composition comprises about 35% sodium formate and 65% potassium chlorate, for example. When these react the low melting slag of potassium chloride and sodium oxide collects on cooler surfaces of the gas generator thereby reducing heat input to the inflatable bag and substantially preventing formation of smoke.

12 Claims, No Drawings

METHOD OF INFLATING AN AUTOMOBILE PASSENGER RESTRAINT BAG

BACKGROUND

This is a continuation in part of my application Ser. No. 234,312, filed Mar. 13, 1972, now abandoned. Governmental requirements for automobile passenger restraint systems include an inflatable bag that momentarily and temporarily restrains a passenger during the critical instant of a collision impact. For safe and successful use, the bag must be inflated in a very short time and thereafter deflated to release the passenger. The gas used to inflate the bag must be cool enough to avoid damage to the bag and injury to the passenger. For similar reasons, it is important that hot particles do not reach the interior of the bag. The gasses used must have a low toxicity and for this reason carbon monoxide, nitrogen oxides, sulphur compounds and the like are undesirable.

In some embodiments, deflation of the bag is obtained by using a fabric of controlled porosity since the entire phenomenon of passenger restraint is kinetic. Thus, the bag rapidly inflates without a substantial pressure gradient across the fabric and little gas flows therethrough during the short time interval of inflation. Substantial pressures may be created in the bag as it restrains a passenger during impact and the energy of the passenger is dissipated over a period of time which is controlled by the porosity of the fabric. Quite a bit of gas is pushed out of the bag during this time. Subsequently the bag deflates as gas flows through the fabric over a somewhat longer period of time. Since the gas in such an embodiment is dissipated in the passenger compartment of the automobile in close proximity to the passenger being restrained, low temperature and low toxicity are of appreciable importance. In addition, it is important that the gas be relatively free from smoke so as not to inhibit visibility by the driver or passengers and avoid any skin, eye or respiratory irritations that might arise from smoke particles. It is, therefore, desirable to provide pyrotechnic compositions that burn to produce a large volume of relatively cool, non-toxic, smoke-free gas in a very short time interval for inflating a passenger restraint bag.

The pyrotechnic composition must be sufficiently stable to sustain the temperature, vibration and other environmental characteristics of an automobile for a prolonged period without degradation of performance. In a typical embodiment, about 265 grams of pyrotechnic composition may be employed for inflating a five cubic foot bag. For this reason it is desirable that the composition be relatively inexpensive.

BRIEF SUMMARY OF THE INVENTION

Thus, in practice of this invention according to a presently preferred embodiment, there is provided a technique for inflating an automobile passenger restraint bag with a relatively cool, nontoxic, substantially smoke free gas generating composition comprising a mixture of an oxidizer compound containing oxygen and a metal and an oxygen bearing metal organic compound selected so that a stoichiometric reaction therebetween yields gaseous carbon dioxide and water vapor and a low melting, at least binary mixture of metal salts and a net heat of reaction less about 1,000 calories per gram. An excess of oxidizer over the stoichiometric proportion may be used to provide oxygen in the gas.

DESCRIPTION

It is known that one can mix an oxidizer powder and a reducing powder and ignite them to produce a mixture of carbon dioxide and water vapor for inflating a passenger restraint bag for an automobile. Such powders are mixed and packed into a cavity in a gas generator. An electrical initiator is provided in the cavity for adding a sudden localized burst of energy for raising the temperature of the pyrotechnic mixture well above its ignition temperature. Once ignited, the entire mixture is typically consumed to produce carbon dioxide and/or water vapor which are directed to a passenger restraint bag for inflation. Some of the products of combustion are typically not gaseous and may remain in the gas generator or pass into the passenger restraint bag in the form of hot particles or as a smoke of finely divided particles.

The same general technique is employed in practice of this invention, except that compositions are provided with low net heat of reaction and which produce substantially smoke free gasses and a low melting slag that deposits within the gas generator rather than being carried into the passenger restraint bag.

Previously it has been proposed to employ carbohydrates and oxidizing agents in the form of powdered mixtures for deflagration to generate gasses to inflate a fabric bag. The gasses produced are generally too hot and some type of cooling, such as endothermic chemicals or mechanical heat exchangers are used to assure that the gasses reaching the inflatable bag are less than about 500°F. which is presently considered to be an approximate maximum temperature for safe use in a passenger restraint system. Thus, for example, when a stoichiometric mixture of sucrose and potassium chlorate is reacted, there is a net heat of reaction of about 1,080 calories per gram. Citric acid and potassium chlorate reacted in a stoichiometric mixture have a net heat of reaction of about 912 calories per gram. When tartaric acid and potassium perchlorate are reacted stoichiometrically, the net heat of reaction is about 792 calories per gram which is one of the lowest calorific outputs available from a suitable carbohydrate. Other carbohydrates may be suitable from an energy point of view, but unsuitable because of low melting point, low decomposition temperature, high cost, toxicity, or the like.

The pyrotechnic mixtures utilized in practice of this invention overcome many of the physical and chemical problems associated with the organic materials having low net heats of reaction. Substantial variations in properties can be obtained in practice of this invention, which allows considerable latitude in adjusting the calorific output of the pyrotechnic mixture to an optimum level for a particular application.

The oxidizers employed in practice of this invention are compounds including oxygen and a metal, and are preferably selected from the class of the chlorates and perchlorates of sodium, potassium, lithium, barium, magnesium and calcium. In addition, the peroxides, superoxides and permanganates of these metals may be suitable. Other oxidizers that are suitable include chlorates of aluminum, cadmium, lead, and nickel; perchlorates of barium, lead, manganese and nickel; ammonium chlorate; ammonium perchlorate; cobaltous chlorate; cobaltous perchlorate; cupric chlorate; and ferrous perchlorate. Some of these are more hygroscopic than the preferred materials and need protection from water vapor. The ammonium chlorate and ammonium perchlorate yield ammonium chloride upon reaction which also forms a low melting slag with metal salts. The chlorates and perchlorates are particularly preferred, since the non-gaseous product resulting from reaction is the chloride of the metal. As pointed out hereinafter, the combination of the metal chloride with other metal containing reaction products, serves to make a low melting mixture which collects on the walls of the gas generator rather than being carried into the passenger restraint bag.

The pyrotechnic composition also includes an oxygen containing metal organic compound which reacts with the oxidizer when the pyrotechnic mixture is ignited. As mentioned hereinafter, a substantial number of oxygen bearing metal organic compounds are suitable. Particularly preferred compounds include calcium formate, lithium formate, lithium acid oxalate, potassium formate, potassium acid oxalate, sodium formate, and sodium acid oxalate. Reaction of any of these materials with the above identified oxidizers yields a large volume of gas in the form of carbon dioxide and water vapor without unduly high caloric outputs. Thus, for example, the net heat of stoichiometric reaction of calcium formate and potassium perchlorate is only 426 calories per gram. Similarly, the net heat of stoichiometric reaction of sodium formate and potassium perchlorate is only 220 calories per gram. A mixture of 67% potassium formate and 33% potassium chlorate has a net heat of only 52 calories per gram. Approximately the same quantities of gas are produced from equal weights of each of these pyrotechnic mixtures and the total caloric output of the reaction is quite low. By mixing various oxygen containing metal organic compounds in the pyrotechnic composition a broad range of net heat outputs and low melting slags can be provided.

The metal formates identified above are preferred in practice of this invention since the net heat of reaction with an oxidizer is quite low and yet the reaction is sufficiently exothermic that once initiated it continues to completion. The net heat of a pyrotechnic composition can be reduced by including a metal acid oxalate along with the metal formate. This reduces the temperature of the reaction products. The general reason for this can be understood by noting that the formula for the metal formates is $MH_2C_2O_4$, where M indicates any metal and it will be understood that suitable adjustments in the formula will be made for the metal valence. The formula for the metal acid oxalate, on the other hand, is $MHC_2O_4$. By selecting suitable mixtures of metal formate, and metal acid oxalate, a broad range of net heats of reaction can be obtained in order to adjust the temperature of the reaction products and the rapidity of the combustion reaction. Exemplary of the low net heats of reaction obtainable in practice of this invention include 27% potassium chlorate and 73% barium formate with a net heat of reaction of about 223calories per gram. When 78% lead formate is reacted with 22% potassium chlorate a net heat of about 300 calories per gram is obtained. Zinc formate and potassium chlorate in the stoichiometric proportion yield a net heat of about 506 calories per gram. With such a variety available, almost any desired net heat of reaction is obtainable with suitable mixtures of reactants.

The metal acid oxalates are useful since the caloric output is low and the rate of reaction may be sufficient to be self-sustaining. From all of these materials, nontoxic gases are obtained.

Although the formates, and acid oxalates of sodium, potassium, lithium and calcium are particularly preferred in practice of this invention, a larger group of materials has also been found suitable for practice of this invention. Thus the following oxygen bearing metal organic compounds are found to be suitable components of a pyrotechnic mixture: aluminum acetate, aluminum citrate, barium formate, barium acetate, barium citrate, barium butyrate, barium malonate, barium propionate, barium succinate, cadmium formate, cadmium acetate, cadmium lactate, calcium formate, calcium acetate, calcium citrate, calcium tartrate, calcium lactate, calcium benzonate, calcium salicylate, cerous acetate, cesium acid tartrate, chromic acetate, cobaltous acetate, columbium acid oxalate, cupric formate, cupric acetate, dysprosium acetate, erbium acetate, ferric acetate, ferrous formate, ferrous acetate, ferrous tartrate, ferrous lactate, gadolinium acetate, lead formate, lead acetate, lithium formate, lithium acetate, lithium citrate, lithium acid oxalate, lithium benzoate, lithium salicylate, magnesium formate, magnesium acetate, magnesium citrate, magnesium tartrate, magnesium benzoate, manganese formate, manganese acetate, manganese lactate, manganese benzoate, nickel formate, nickel acetate, potassium formate, potassium acetate, potassium acid acetate, potassium citrate, potassium tartrate, potassium acid tartrate, potassium acid oxalate, potassium benzoate, potassium acid phthalate, samarium formate, samarium acetate, silver acetate, silver citrate, silver tartrate, sodium formate, sodium acetate, sodium citrate, sodium tartrate, sodium acid tartrate, sodium acid oxalate, sodium salicylate, sodium methylate, strontium formate, strontium acetate, strontium tartrate, strontium lactate, strontium salicylate, thallium acetate, ytterbium acetate, zinc formate, and zinc acetate.

Some of these materials are less suitable than the particularly preferred group because of cost or somewhat higher net heat of reaction or formation of a somewhat higher melting point binary mixture after reaction with the oxidizer. In some cases, despite these factors, the materials are quite useful in combination with the oxygen bearing metal organic compounds, particularly preferred in the pyrotechnic composition.

Materials in this larger group of oxygen bearing metal organic compounds can be used in practice of this invention, either alone or in a variety of mixtures thereof. Such mixtures are of considerable assistance in tailoring the pyrotechnic composition to particular performance criteria, such as reaction time, net heat of reaction, resultant gas composition and temperature and melting point of the mixture of non-gaseous products.

An intermediate group of oxygen containing metal organic compounds has been identified as suitable for practice of this invention. These materials combine readily with the above identified oxidizers and give good gas volumes without high net heat output or excess smoke. Good low melting slags are produced. This intermediate group of compounds comprises: aluminum citrate, barium formate, barium citrate, calcium formate, calcium citrate, calcium acid tartrate, chromic acetate, cupric formate, ferrous tartrate, lithium formate, lithium acid oxalate, lithium citrate, magnesium formate, magnesium citrate, magnesium tartrate, manganese formate, nickel formate, potassium formate, potassium acid oxalate, potassium citrate, potassium tartrate, potassium acid tartrate, silver citrate, silver tartrate, sodiun formate, sodium acid oxalate, sodium citrate, sodium tartrate, sodium acid tartrate, strontium formate, strontium tartrate, zinc formate, and zinc oxalate.

These materials may be used alone or in combination with other preferred oxygen bearing metal organic compounds for applications requiring a particular net heat of reaction or unique combination of reaction products.

The materials listed above are exemplary of compounds including a single metal rather than a plurality of metals and it will be understood that there are additional compounds suitable for practice of this invention having two metal ions in the oxygen bearing organic compound. Thus, for example, sodium potassium tartrate is well suited to practice of this invention. Many other oxygen bearing metal organic compounds having more than one metal ion in the molecule will be apparent. Such binary metal organic compounds can be particularly useful in combination with an oxidizer having still a third metal in order to produce ternary non-gaseous reaction product mixtures having quite low melting points.

It is preferred that the proportion of oxidizer compound and oxygen bearing metal organic compound be present in the pyrotechnic composition in a proportion that reacts to produce gasses consisting primarily of carbon dioxide and water vapor, primarily to avoid formation of carbon monoxide which is toxic. Even though carbon dioxide and water are not toxic, they can displace oxygen from the local environment and it is therefore often desirable to have a proportion of oxygen in the reaction product as well. This is readily accomplished by increasing the proportion of oxidizer compound above the stoichiometric proportion. Thus, for example, when two moles of sodium formate are reacted with one mole of potassium perchlorate, the reaction products include two moles of carbon dioxide and one mole each of water vapor and oxygen. The net heat of reaction is only 164 calories per gram and 25% of the gas is oxygen. If larger proportions of oxygem or pyrotechnic compositions with lower caloric outputs are desired, still higher excesses of oxidizer above stoichiometry may be used. This is done at the expense of burning rate of the pyrotechnic; however, this can ordinarily be compensated for by variation in the geometry of the gas generator and increase of the energy of the electric initiator to achieve an optimum burning rate. Generally speaking, it is preferred that the excess of oxidizer over the stoichiometric proportion be no more than about 30% by weight of the total pyrotechnic mixture, so that special means are not required for adjusting burning rate or the like and the compositions are more universally useful. It is preferred that the oxidizer compound be present in a proportion less than about 30% over the stoichiometric proportion, since the volume of gas obtained by reaction is greater than the volume of gas obtained by mere decomposition and there is no substantial benefit in further increasing the oxygen content of the reaction products.

Since some of the reactions between the inorganic oxidizers and oxygen bearing metal organic compounds have very low net heats of reaction, it is sometimes found that the rate of reaction is rather slow for a successful automobile passenger restraint system. The rate of reaction can be enhanced by energetic initiation of the combustion of the powder mixture. Such initiation of the reaction can be accomplished by a variety of chemical reactions that generate high temperatures. Many such initiators, however, introduce toxic gases and should be avoided. It is, therefore, particularly preferred to initiate the reaction in the gas generator by a deflagration mixture formed of the powders of an inorganic oxidizer compound and an oxygen bearing organic fuel. Generally speaking, the oxidizer compounds hereinabove identified are suitable for the initiation mixture. In particular, the chlorates and perchlorates of the alkali metals are preferred.

The oxygen bearing organic fuel is one having a formula $C_xH_yO_z$ where x, y and z are integers. The powder should have an average particle size less than about 25 microns and be solid at all temperatures below about 165°F in order to be satisfactory for an automobile passenger restraint system. Suitable organic fuels can be selected from the group consisting of sucrose, starch, cellulose, dextrose, dextrin, fructose, lactose, ascorbic acid, benzoic acid, maltose monohydrate, mannitol, mannoheptose, mannoheptose monohydrate, oxalic acid, propanediolic acid and glyoxylic acid. Preferably the oxidizer and fuel are mixed in stoichiometric proportions for producing principally carbon dioxide and water vapor as the gaseous products, since this yields a maximum initiation energy. In a typical embodiment for a 500 gram main charge, as hereinabove described, an initiator mixture of about 25 grams is sufficient. Many other high energy initiation techniques will be apparent to one skilled in the art.

As suggested above, a reaction of important significance to the overall performance of the gas generator system for a passenger restraint bag, involves the non-gaseous products of the reaction between the oxidizer compound and the oxygen bearing metal organic compound. The reaction typically produces a metal oxide and when the chlorates or perchlorates are used, a metal chloride. Such binary mixtures of metal salts have melting points that are below the melting point of either of the metal salts alone. The binary mixtures of metal oxide and metal chloride, have particularly low melting points and combinations of oxidizer and metal organic compound yielding such a mixture upon reaction are preferred. If oxidizers are used that do not yield a metal chloride, it is preferred that different metal ions be present in at least part of the oxidizer and metal organic. This assures at least a binary mixture of metal salts for getting a melting point lower than either metal salt alone. Ternary or more complex mixtures of metal salts may be used for low melting.

The melting point of the non-gaseous reaction products is of considerable importance in an automobile passenger restraint system in keeping the reaction products from entering the passenger restraint bag. Previously, when a metal oxide or metal chloride or the like was produced from a pyrotechnic composition, the temperature of the product was such that most of it was in solid form which passed into the passenger restraint bag, either as hot particles or in a sufficiently finely divided form to appear as a smoke. Neither of these is satisfactory.

With low melting mixtures as provided in practice of this invention, the non-gaseous products apparently remain in liquid form for a longer period and can solidify on the cooler walls of the gas generator and similar solid surfaces. Thus, it is found that instead of producing a smoke in the passenger restraint bag, a spongy mass of a ceramic like material forms in the gas generator and very little, if any, smoke goes to the bag.

One approach to inhibiting hot particles from entering the passenger restraint bag has been to pass the reaction products through a porous member en route to the bag. It is sometimes found that the particles of non-gaseous reaction product accumulate in the pores and tend to plug up such a filter. When a low melting mixture of non-gaseous reaction product is directed against such a filter, a spongy mass collects which is in itself porous and little deleterious plugging of porous filters is noted.

In addition to inhibiting the presence of smoke and hot particles in the passenger restraint bag, the low melting mixture of non-gaseous reaction products accounts for a substantial proportion of the reaction heat. Since these products collect on the walls of the gas generator, much of the heat remains in the gas generator and is not conveyed into the passenger restraint bag. This enhanced retention of heat in the gas generator itself permits the use of pyrotechnic mixtures having somewhat higher net heats of reaction than could be tolerated if the non-gaseous reaction products were largely passed to the passenger restraint bag as has been the case previously.

In the simplest embodiment, the low melting mixture of non-gaseous reaction products is a binary mixture such as, for example, calcium oxide and potassium chloride, sodium oxide and sodium chloride, lithium chloride and potassium oxide, or sodium oxide and potassium chloride. As is well known in the ceramic arts, ternary mixtures non-gaseous reaction products such as, for example, nickel oxide, potassium oxide and sodium chloride may be lower than the melting point obtainable with any of the three possible binary mixtures. Thus, in practice of this invention, the metal containing oxidizer and the oxygen bearing metal organic compound are selected so that the non-gaseous reaction products form at least a binary mixture of metal salts having a melting point less than the melting point of any of the metal salts formed by the reaction. If desired, ternary, quaternary or other mixtures of metal salts may be created for significant melting point reductions.

Preferably the pyrotechnic mixture comprises an intimate combination of oxidizer compound powder and oxygen bearing meta organic powder. This has the advantage of not requiring any binders or cements which could interfere with reaction or introduce toxicity in the combination. Such powders are preferably compacted at light pressures, such as for example, 50 to 100 psi although substantially higher compaction pressures can be employed without significantly affecting the rate of reaction. Preferably the compaction pressure is less than about 5,000 psi, since pressures in that order may alter the burning characteristics of the pyrotechnic mixture. A compacted powder is less affected by vibration like that encountered in a passenger restraint system in an automobile, than are pellets or grains which may break up and therefore change their burning characteristics. If desired, the burning rate of the powder can be controlled by the compaction pressure and it is also susceptible to packing into gas generators of non-uniform cross section, which may be employed for controlling the burning rate. Preferably the particle size of the metal organic compound and the oxidizer is less than about 25 microns in order to obtain substantially complete reaction without a residue of unburned materials or undue production of hot reaction particles. When the particle size of both the metal organic powder and the oxidizer powder is less than about 5 microns, substantially complete reaction therebetween is virtually certain and unintentional formation of carbon monoxide thereby inhibited.

Particularly preferred combinations of metal containing oxidizer powder and oxygen bearing metal organic compound forming a pyrotechnic composition include calcium formate in the range of from about 35% to 60% by weight and potassium chlorate in the range of from 40% to 65% by weight; calcium formate in the range of from about 40% to 65% by weight and potassium perchlorate in the range of from about 35% to 60% by weight; sodium formate in the range of from about 35% to 60% by weight and potassium chlorate in the range of from about 40% to 65% by weight; sodium formate in the range of from about 40% to 65% by weight and potassium perchlorate in the range of from about 35% to 60% by weight; nickel formate in the range of from about 50% to 69% by weight and potassium chlorate in the rangeof from about 31% to 50% by weight; and nickel formate in the range of from about 65% to 72% by weight and potassium perchlorate in the range of from about 28% to 35% by weight.

Particularly preferred compositions comprise potassium chlorate in a proportion of about 65% and either sodium formate or calcium formate in a proportion of about 35% by weight. The composition including calcium formate is particulary well suited for inflating a passenger restraint bag deployed from the center of a steering wheel in an automobile. The reaction is relatively rapid and the restraint bag can be completely inflated in about 25 milliseconds. The sodium formate bearing composition is particulary preferred for the right front passanger seat of an automobile. The reaction is somewhat slower than the one between calcium formate and potassium chlorate and the passenger restraint bag is completely inflated in about 50 to 60 milliseconds.

Other preferred compositions include about 30% calcium formate, 30% potassium acid oxalate and 40% potassium chlorate which reacts with a net heat of about 200 calories per gram. The resultant slag is a ternary mixture of potassium chloride, potassium oxide and calcium oxide which has a melting point substantially below 1,400°F. Another preferred composition comprises about 30% sodium formate, 30% potassium acid oxalate and 40% potassium chlorate. The ternary slag produced by such reaction has a melting point in the range of about 800° to 1,000°F. Another suitable composition having a ternary slag and low net heat of reaction comprises about 30% calcium oxalate, 30% calcium formate and 40% potassium chlorate.

A large number of pyrotechnic compositions in accordance with principles of this invention have been made and tested by igniting them in a gas generator connected to an inflatable passenger restraint bag. In various tests performed, time of bag inflation, pressure in the gas generator, volume of gas produced, temperature of gas in the bag, gas composition, smoke formation and the like have been measured. In addition, the presence or absence of hot particles in the inflation bag and characteristics of deposits in the gas generator have been observed. Other tests include calorimetry, bench tests of burn rate, gas production tests, and the like with an actual bag connected to the gas generator. Among the many tests performed, the following pyrotechnic compositions have performed satisfactorily in tests evaluating performance of this invention:

1. Calcium formate 60%, potassium chlorate 40%;
2. Calcium formate 45%, potassium chlorate 55%;
3. Calcium formate 35%, potassium chlorate 65%;
4. Calcium formate 65%, potassium perchlorate 35%;
5. Calcium formate 50%; potassium perchlorate 50%;
6. Calcium formate 40%, potassium perchlorate 60%;
7. Sodium formate 60%, potassium chlorate 40%;
8. Sodium formate 45%, potassium chlorate 55%;
9. Sodium formate 35%, potassium chlorate 65%;
10. Sodium formate 65%, potassium perchlorate 35%;
11. Sodium formate 50%, potassium perchlorate 50%;
12. Sodium formate 40%, potassium perchlorate 60%;
13. Nickel formate 69%, potassium chlorate 31%;
14. Nickel formate 50%, potassium chlorate 50%;
15. Nickel formate 72%, potassium perchlorate 28%;
16. Nickel formate 65%, potassium perchlorate 35%;
17. Calcium formate 30%, potassium acid oxalate 30%, potassium chlorate 40%;
18. Sodium formate 30%, potassium acid oxalate 30%, potassium chlorate 40%;
19. Calcium formate 30%, calcium oxalate 30%, potassium chlorate 40%;
20. Manganese formate 64%, potassium chlorate 36%;
21. Potassium formate 67%, potassium chlorate 44%;
22. Lithium formate 56%, potassium chlorate 44%;
23. Magnesium formate 58%, potassium chlorate 42%;
24. Ammonium formate 60%, potassium chlorate 40%;
25. Barium formate 73%, potassium chlorate 27%;
26. Cupric formate 65%, potassium chlorate 35%;
27. Ferrous formate 68%, potassium chlorate 32%;
28. Lead formate 78%, potassium chlorate 22%; and
29. Zinc formate 65%, potassium chlorate 35%.

Although numerous embodiments of this invention have been set forth herein, many additional modifications and variations will be apparent to one skilled in the art. It is therefore to be understood that within the scope of the appended claims the invention may be practiced otherwise than as specifically described.

What is claimed is:

1. A method of inflating an automobile passenger restraint bag comprising the step of substantially completely inflating the bag with the gaseous combustion products of combustion reaction of a composition consisting essentially of an oxidizer compound selected from the group consisting of the chlorates and perchlorates of sodium, potassium, lithium, barium, magnesium and calcium; and an oxygen bearing metal organic compound, said oxygen bearing metal organic compound selected such that a stoichiometric reaction between the oxidizer compound and the metal organic compound yields gaseous products selected from the group consisting of carbon dioxide and water vapor and non-gaseous products of at least a binary mixture of metal salts having a melting point substantially below the melting point of any of the resultant metal salts and having a net heat of reaction of less than about 1,000 calories per gram, the production of oxidizer compound being no less than the stoichiometric proportion; and wherein the metal organic compound is selected from the group consisting of metal formates and metal acid oxalates.

2. A method of inflating an automobile passenger bag comprising the step of substantially completely inflating the bag with the gaseous combustion products of reaction of a composition consisting essentially of an oxidizer compound containing a metal selected from the group consisting of sodium, potassium, lithium, barium, magnesium and calcium and also containing oxygen; and an oxygen bearing metal organic compound, said oxygen bearing metal organic compound selected from the group consisting of metal acid oxalates and metal formates.

3. A method of inflating an automobile passenger restraint bag as defined in claim 2 wherein the metal organic compound is selected from the group consisting of calcium formate, lithium formate, lithium acid oxalate, potassium formate, potassium acid oxalate, sodium formate, and sodium acid oxalate; and the oxidizer compound is selected from the group consisting of the chlorates and perchlorates of soidum, potassium, lithium, barium, magnesium and calcium.

4. A method of inflating an automobile passenger restraint bag comprising the step of substantially completely inflating the bag with the gaseous products of combustion of a composition consisting essentially of an oxidizer compound, and an oxygen bearing metal organic compound, said oxidizer compound selected from the group consisting of sodium chlorate, sodium perchlorate, potassium chlorate, potassium perchlorate, lithium chlorate, lithium perchlorate, barium chlorate, barium perchlorate, magnesium chlorate, magnesium perchlorate, calcium chlorate, calcium perchlorate, aluminum chlorate, ammonium chlorate, ammonium perchlorate, cadmium chlorate, cobaltous chlorate, cobaltous perchlorate, cupric chlorate, ferrous perchlorate, lead chlorate, lead perchlorate, manganese perchlorate, nickel chlorate and nickel perchlorate; and said oxygen bearing metal organic compound being selected from the group consisting of aluminum acetate, aluminum citrate, barium formate, barium acetate, barium citrate, barium butyrate, barium malonate, barium propionate, barium succinate, cadmium formate, cadmium acetate, cadmium lactate, calcium formate, calcium acetate, calcium citrate, calcium tartrate, calcium lactate, calcium benzonate, calcium salicylate, cerous acetate, cesium acid tartrate, chromic acetate, cobaltous acetate, columbium acid oxalate, cupric formate, cupric acetate, dysprosium acetate, erbium acetate, ferric acetic, ferrous formate, ferrous acetate, ferrous tartrate, ferrous lactate, gadolinium acetate, lead formate, lead acetate, lithium formate, lithium acetate, lithium citrate, lithium acid oxalate, lithium benzoate, lithium salicylate, magnesium formate, magnesium acetate, magnesium citrate, magnesium tartrate, magnesium benzoate, manganese formate, manganese acetate, manganese lactate, manganese benzoate, mercuric acetate, mercurous formate, mercurous acetate, nickel formate, nickel acetate, potassium formate, potassium acetate, potassium acid acetate, potassium citrate, potassium tartrate, potassium acid tartrate, potassium acid oxalate, potassium benzoate, potassium acid phthalate, samarium formate, samarium acetate, silver acetate, silver citrate, silver tartrate, sodium formate, sodium acetate, sodium citrate, sodium tartrate, sodium acid tartrate, sodium acid oxalate, sodium salicylate, sodium methylate, strontium formate, strontium acetate, strontium tartrate, strontium lactate, strontium salicylate, thallium acetate, ytterbium acetate, zinc formate, and zinc acetate.

5. A method of inflating an automobile passenger restraint bag as defined in claim 4 wherein the oxygen bearing metal organic compound is selected from the group consisting of barium formate, calcium formate, cupric formate, lithium formate, lithium acid oxalate, magnesium formate, manganese formate, nickel formate, potassium formate, potassium acid oxalate, sodium formate, sodium acid oxalate, strontium formate, and zinc formate.

6. A method of inflating an automobile passenger restraint bag as defined in claim 5 wherein the oxidizer compound is selected from the group consisting of the chlorates and perchlorates of sodium, potassium, lithium, barium, magnesium and calcium.

7. A method of inflating an automobile passenger restraint bag as defined in claim 4 wherein the oxidizer compound is selected from the group consisting of the chlorates and perchlorates of sodium, potassium, lithium, barium, magnesium and calcium.

8. A method of inflating an automobile passenger restraint bag as defined in claim 4 wherein the oxygen bearing metal organic compound is selected from the group consisting of calcium formate, lithium formate, lithium acid oxalate, potassium formate, potassium acid oxalate, sodium formate, and sodium acid oxalate.

9. A method of inflating an automobile passenger restraint bag as defined in claim 4 wherein the composition subject to combustion reaction consists essentially of about 65% by weight of potassium chlorate and about 35% by weight of calcium formate.

10. A method of inflating an automobile passenger restraint bag as defined in claim 4 wherein the composition subject to combustion reaction consists essentially of about 65% by weight of potassium chlorate and about 35% by weight of sodium formate.

11. A method of inflating an automobile passenger restraint bag as defined in claim 4 wherein the proportion of oxidizer compound to metal organic compound is in the range from a stoichiometric proportion to an excess of 30% by weight over the stoichiometric proportion based on the total weight of the mixture.

12. A method of inflating an automobile passenger restraint bag comprising the step of substantially completely inflating the bag primarily with the gaseous combustion products of reaction of a mixture consisting essentially of an oxidizer compound and an oxygen bearing metal organic compound selected from the group consisting of calcium formate in the range of from about 35% to 60% by weight and potassium chlorate in the range of from about 40% to 65% by weight; calcium formate in the range of from about 40% to 65% by weight and potassium perchlorate in the range of from about 35% to 60% by weight; sodium formate in the range of from about 35% to 60% by weight and potassium chlorate in the range of from about 40% to 65% by weight; sodium formate in the range in the range of from about 40% to 65% by weight and potassium perchlorate in the range of from about 35% to 60% by weight; nickel formate in the range of from about 50% to 69% by weight and potassium chlorate in the range of from about 31% to 50% by weight; nickel formate in the range of from about 65% to 72% by weight and potassium perchlorate in the range of from about 28% to 35% by weight; calcium formate in a proportion of about 30% by weight, potassium acid oxalate in a proportion of about 30% by weight and potassium chlorate in a proportion of about 40% by weight; sodium formate in a proportion of about 30% by weight, potassium acid oxalate in a proportion of about 30% by weight and potassium chlorate in a proportion of about 40% by weight; and calcium formate in a proportion of about 30% by weight, calcium oxalate in a proportion of about 30% by weight and potassium chlorate in a proportion of about 40% by weight.

* * * * *

UNITED STATES PATENT AND TRADEMARK OFFICE

CERTIFICATE OF CORRECTION

PATENT NO. : 3,964,255

DATED : June 22, 1976

INVENTOR(S) : Vincent O. Catanzarite

It is certified that error appears in the above-identified patent and that said Letters Patent are hereby corrected as shown below:

Column 7, line 49, "meta" should be -- metal --.

Column 8, line 38, "passanger" should be -- passenger --.

Column 9, line 62, "production" should be --proportion --.

Column 10, line 19, "soidum" should be -- sodium --.

Column 10, line 48, "Acetic" should be -- acetate --.

Signed and Sealed this

Thirty-first Day of August 1976

[SEAL]

*Attest:*

RUTH C. MASON
*Attesting Officer*

C. MARSHALL DANN
*Commissioner of Patents and Trademarks*